United States Patent [19]

Goncalves

[11] Patent Number: 4,506,808

[45] Date of Patent: Mar. 26, 1985

[54] DISPENSER CAP FOR A PRESSURIZED CONTAINER AND A CORRESPONDING UNIT

[75] Inventor: Antonin L. Goncalves, Groslay, France

[73] Assignee: L'Oreal, Paris, France

[21] Appl. No.: 443,052

[22] Filed: Nov. 19, 1982

[30] Foreign Application Priority Data

Dec. 3, 1981 [FR] France ..... 81 22650
Apr. 7, 1982 [FR] France ..... 82 06074

[51] Int. Cl.[3] ..... B67D 5/06; B65D 83/00
[52] U.S. Cl. ..... 222/182; 222/402.13
[58] Field of Search ..... 222/153, 182, 402.13, 222/402.15, 509, 517, 541, 556, 402.1, 402.11, 402.12

[56] References Cited

U.S. PATENT DOCUMENTS

| | | | |
|---|---|---|---|
| 3,180,531 | 4/1965 | Beard, Jr. et al. | 222/182 |
| 3,185,350 | 5/1965 | Abplanalp et al. | 222/182 |
| 3,272,394 | 9/1966 | Sagarin | 222/182 |
| 3,329,320 | 7/1967 | Braun | 222/402.13 |
| 4,132,333 | 1/1979 | Debard | 222/402.13 |

FOREIGN PATENT DOCUMENTS

| | | | |
|---|---|---|---|
| 2752563 | 3/1979 | Fed. Rep. of Germany | 222/402.13 |
| 1512794 | 2/1968 | France . | |
| 2140969 | 1/1973 | France . | |
| 920963 | 3/1963 | United Kingdom . | |
| 1033576 | 6/1966 | United Kingdom . | |
| 1179304 | 1/1970 | United Kingdom . | |
| 1333832 | 10/1973 | United Kingdom . | |
| 1493031 | 11/1977 | United Kingdom . | |
| 1493032 | 11/1977 | United Kingdom . | |
| 1507784 | 4/1978 | United Kingdom . | |
| 1542740 | 3/1979 | United Kingdom . | |
| 2003992 | 3/1982 | United Kingdom . | |
| 2097961 | 10/1982 | United Kingdom . | |

*Primary Examiner*—Joseph J. Rolla
*Assistant Examiner*—Michael S. Huppert
*Attorney, Agent, or Firm*—Cushman, Darby & Cushman

[57] ABSTRACT

A dispenser cap for an "aerosol can" container comprises a fixed cap body and a push button within the cap body. The push button is articulated to guides of the cap body, these guides including notches to abut the crimped rim of the valve carrying cap of the aerosol container for which the cap is intended.

The articulation is achieved by means of trunnion elements of the push button resiliently engaging in corresponding recesses of the guides of the cap body.

16 Claims, 8 Drawing Figures

DISPENSER CAP FOR A PRESSURIZED CONTAINER AND A CORRESPONDING UNIT

FIELD OF THE INVENTION

The present invention concerns a dispenser cap intended to be associated with a pressurised container of the "aerosol can" type.

PRIOR ART

The dispenser caps known and used hitherto are generally made of two parts, the one fixed, the other movable. The fixed part, formed by the cap skirt, is fixed to the top part of the associated pressurised container whilst the movable part, in the form of a push button, is fitted on the outlet tube of the discharge valve of the pressurised container. The valve is most frequently disposed on the mounting cap which itself is fixed by an annular crimped rim on the top part of the container body.

The attachment of the cap skirt may be effected on the crimped rim of the valve carrier cup of the pressurised container, in which case, the cap skirt has a smaller diameter than that of the container body and the push button, which is accommodated within the cap skirt, is necessarily of a small dimension and hence difficult to operate. More advantageously, the attachment of the cap skirt may be effected directly on the side wall of the container body, for instance, by the catch engagement of a continuous or discontinuous retaining ring provided on the bottom of the cap skirt within a preformed groove provided on the side wall of the container. In that case, the cap skirt may have a diameter which is substantially equal to that of the container and the push button, which is accommodated therein, may have a greater dimension and hence be more easily operated.

In the conventional way, the push button comprises a duct bent at right angles whose axial branch co-operates with the outlet tube of the discharge valve and whose radial branch terminates at an ejection nozzle disposed opposite a window in the wall of the cap skirt. The bent duct of the push button is advantageously surmounted by a tongue extending radially and whose length is, for reasons of ease of operation, substantially equal to the inner diameter of the cap skirt.

In a known embodiment, the push button is disposed between two guides which are integral with the cap skirt and are used to guide the deflection of the push button along the axis of sliding of the outlet tube of the discharge valve and perpendicular to the articulation axis of the push button on the cap skirt.

To reduce the force required for the lowering of the outlet tube of the discharge valve by means of the push button as much as possible, and to reduce also the risks of damaging the discharge valve during use, it is indispensible, on the one hand, for the axis of articulation of the push button to be as close as possible to the wall of the cap skirt and for the said axis to be disposed substantially at the level of the top end of the outlet tube of the valve. To meet such a condition without arranging the tongue of the push button clearly below the top face of a cap skirt of normal height, whence there would ensue at the top of the cap an unsightly discontinuity formed by the push button tongue disposed between the two guides at a level clearly lower than that of the top of the cap body, the front face of the push button in which the ejection nozzle is disposed is provided with a downward extension parallel to the axis of the cap skirt and carrying at its bottom the hinging means of the push button on the cap body. The height of the above mentioned extension is chosen so that the articulation axis should be situated substantially at the level of the outlet member of the discharge valve and that the push button tongue should be substantially at the level of the top face of the cap body. Known devices of this type are described and shown in French Patent No. 1 512 794, U.S. Pat. No. 3 180 531 and French Published Patent Application No. 2 401 703.

French Pat. No. 1 512 794 shows a device wherein a front extension of the push button is catch engaged by its bottom end in a hole delimited by an extension of the cap body.

American Pat. No. 3 180 531 shows a device wherein an extension or pin of the push button co-operates with a bottom horizontal wall of a depression formed in the cap body.

French Published Patent Application No. 2 401 703 shows a device comprising a push button whose extension or lever cooperates with a stop of the cap body.

SUMMARY OF THE INVENTION

The object of the present invention is to provide a device in which the guides delimit housings which allow the articulation of the push button and serve to limit the downward movement of the dispenser cap when it is positioned on the associated container by abutting the edge of the valve mounting cup.

A first aspect of the present invention therefore provides a dispenser cap for a pressurised container of the "aerosol can" type, such cap comprising first and second parts, said first part being fixed and said second part movable, the first part consisting of a generally cylindrical cap body adapted to be fixed by catch engagement on the side wall of a said pressurised container and having a top panel, the second part of the cap consisting of a push button pivotally mounted within the cap body between two guides which are integral with the said cap body and are connected to the top panel of the cap body, said push button comprising a duct of bent shape having an axial branch for cooperating with the outlet member of the discharge valve of a said associated container and a radial branch which opens opposite an ejection nozzle carried by the front face of the push button, said push button comprising at least in its zone remote from said radial branch of the duct, an operating tongue extending substantially in a plane perpendicular to said axial branch of the duct, the length of the push button measured perpendicular to the axis of the cap body being substantially equal to the inner diameter of the said cap body, the front face of the push button in which said ejection nozzle is disposed comprising an extension parallel to the axial branch of the duct in a direction which will, in use, be towards the container the said extension having, near its base two coaxial pin elements for articulating the push button on the cap body with an axis of articulation substantially at the level of the end of the outlet member of the valve, said operating tongue of the push button being substantially disposed at the level of the top panel of the cap body, said cap body including a window in register with said ejection nozzle of the push button, said two coaxial pin elements being integral with the said extension and being catch-engaged within corresponding recesses arranged at the bottom of the guides of the cap body and arranged near the window of the said cap body, and the two guides being adapted to abut the annular crimped rim of the valve mounting cup of a said associated pressurised container when the dispenser cap is catch-engaged on the said container.

The push button may have its said frontal extension with a channel-shaped form when viewed in a cross-sectional plane perpendicular to the axis of the axial branch of the bent-shaped duct, the two pin elements being arranged so as to project from the two side flanges of the channel.

The two guides are preferably substantially symmetrical in relation to an axial plane of the cap body and converge towards said window of the said barrel.

More preferably, the edges of said operating tongue of the push button cooperate with the walls of the two guides to guide the push button for deflection substantially within a plane passing through the sliding axis of the outlet member of the discharge valve of a said associated container and perpendicular to the two coaxial pin ends.

Moreover, it is desirable for the operating tongue to be disposed at a level near that of the axis of the radial branch of the bent-shaped duct.

In accordance with a first variant of the dispenser cap according to the invention the operating tongue of the push button is integral with two restraining tabs, in its zone which is on the opposite side from the articulation axis; each restraining tab projects laterally outwardly from the tongue of the push button and is capable of abutting against the floor of a recess on each of said guides of the cap body. The said two restraining tabs serve to limit the rotational movement of the push button in a direction opposite to that corresponding to depression of the outlet member of the discharge valve of a said associated container. Moreover, on assembly, the cap body is upended and the push button may be lowered between the two guides until catch-engagement of the two coaxial pin elements within their recesses and until said two restraining tabs bear against said floors of the recesses of the two guides, the result being that during this operation the push button cannot remove any "tamper-proofing" protective plate of the cap body.

In accordance with a second variant of the cap according to the invention, it is desirable to ensure the provisional holding of the push button in a fixed position within the cap body so as to facilitate the assembly of the cap on the pressurised container. Thus, for temporarily preventing the push button from pivoting around its articulation axis within the cap body, at least one of the restraining tabs of the push button comprises a device which, when the said tabs abut against the floors of said recesses in the two guides, allows catch-engagement of the push button on the side of the recess. This device may for instance be a retaining bead to abut a complementary notch in the recess or conversely, a notch within which a projecting retaining bead of the recess may be catch-fitted. The side of the recess wherein the restraining tab is catch-engaged advantageously slopes such that said side and the axis of the generally cylindrical cap body diverge in an upward direction. In this way, once they have left their catch-engagement positions, the two restraining tabs may be freely displaced within the recesses and cannot on their own reassume their catch-engagement position.

In the dispenser cap according to the above mentioned first variant, the push button is biased to return upwardly by the resiliently biased outlet member of the discharge valve so that before the cap has been assembled on a container, the push button is freely movable in relation to the cap body and may take up a position wherein the bottom end of the axial branch of the duct is not necessarily opposite the discharge valve during automatic positioning of the cap on its associated container. In accordance with the second variant defined above provision is made for retaining means to keep the push button in its uppermost position, i.e. wherein the operating tongue is closest to the top panel of the cap body, during assembly so that the positioning of the axial branch of the duct in relation to the discharge valve should not pose any problem during automatic positioning by machine. However, the first dispensing operation of the container requires disengagement of the said retaining means and, because of this, it is impossible for the push button subsequently to return resiliently into its initial horizontal position; the operating tongue will therefore remain slightly inclined during the use of the container, which is not the best solution.

This problem is resolved by a third variant wherein the retention of the push button in a substantially horizontal operating position, wherein the operating tongue is closest to the top panel of the cap, is ensured by an elastic biasing strip. More precisely, the dispenser cap according to this third variant comprises on the extension of the front face of the push button, at the end remote from said radial branch of the duct and beyond the articulation pins, a forwardly and downwardly projecting elastic strip which ensures that when the push button is placed inside the cap, the strip elastically bears against the inner side wall of the generally cylindrical cap body and biases the push button towards a substantially horizontal position in which the operating tongue is closest to the top panel of the cap body.

The biasing strip is preferably moulded integrally with the push button.

It is advantageous for this strip to have a thickness which is substantially equal to that of the front face extension but a width which is smaller than that of said extension so that it is deformed elastically, prior to that extension.

It is preferable for the elasticity of the strip to be sufficient for the elastic force to restrain the push button in the position in which the operating tongue is closest to the top panel of the cap body, i.e. the uppermost position, without the aid of resilient return biasing elements associated with the outlet member of the discharge valve.

According to another characteristic of the invention, in order to allow the push button to be operated, an opening may be cut in the top of the cap body between the two guides and in the zone of the said guides which is remote from the ejection nozzle. Before the first use of the unit formed by the dispenser cap and the associated pressurized container, the above mentioned opening is obturated by a protective plate connected by moulding to the top panel means of frangible connections integrally moulded with the cap body. If the protective plate has not been removed from the cap on a pressurized container, the user is then certain that the cap container packaging unit that he is acquiring has not been tampered with, or at least that it still encloses the whole of the product which has been introduced into the pressurised container by the manufacturer; on the other hand, rupture of the protective plate signifies that the push button associated with the valve has probably been operated at least once and that the container has therefore already been used.

Preferably the protective plate is provided in its part which is disposed at the centre of the top panel of the cap body, with a pre-cut deformable tab allowing the push button accommodated within the cap body to be operated in the factory for checking proper functioning of the packaging unit.

The discharge valve of the associated pressurised container may, in the conventional manner, be made either with or without a projecting stem.

According to another characteristic of the invention, the side wall or skirt of the cap body comprises internally a continuous or discontinuous retaining bead intended to be catch-fitted within a peripheral groove on the body of the pressurised container. The container body may be made from a single piece by the extrusion of a metal pellet, for instance of aluminium and subsequent forming of the top part of the container body into an ogival shape, a valve mounting cup then being crimped on the top part of the container body. On a "one piece" container of this kind, which is more specifically described in French Published Patent No. 2 177 463 in the name of the assignees of this application, the peripheral attachment groove for the cap is a preformed groove on the container in the connecting zone of the ogival top with the cylindrical side wall of the container. In the case of so-called "two piece" or "three piece" pressurised containers, where the cylindrical side wall of the container body is connected by an annular crimped rim to an ogival top onto which the valve mounting cup is crimped, the peripheral attachment groove of the cap body is below the said annular crimped rim.

A second aspect of the present invention also provides a packaging unit formed by a pressurised container of the "aerosol can" type and a dispenser cap of the first aspect of the invention fitted on one end of the pressurised container, the side wall of the pressurised container comprising a retaining groove serving to fix the cap body by catch-engagement.

BRIEF DESCRIPTION OF THE DRAWINGS

To render the present invention more readily understood, three variants of the invention will now be described below by way of purely illustrative and non-restrictive examples with reference to the accompanying drawings in which.

DESCRIPTION OF THE PREFERRED EMBODIMENTS

Figure 1:
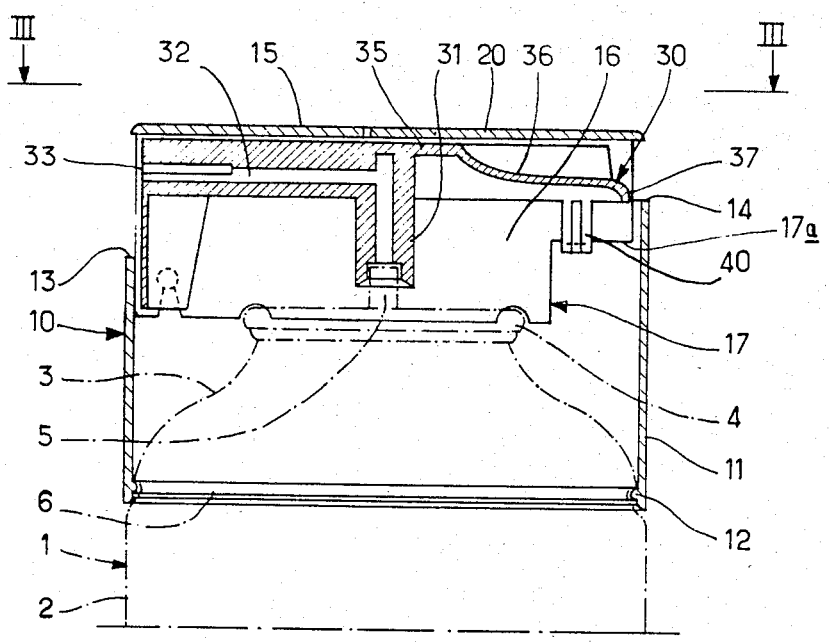
FIG. 1 is an axial cross section showing a dispenser cap according to the first variant of the invention, and the top part of the pressurised container whereon it is catch-fitted.

Referring to the drawings, there will be seen a pressurized container 1 of the "aerosol can" type obtained, for instance, by the extrusion and forming of an aluminium pellet. The container 1 comprises a base (not shown), a cylindrical side wall or barrel 2 and a top 3 of ogival cross-section. A valve mounting cup is fixed by means of an annular crimped rim 4 at the end of the ogival top 3.

The outlet member of the discharge valve of the container 1 is constituted, in a conventional manner, by an axially slidable tube 5. In the connecting zone between the side wall 2 of the container and the ogival top 3 is a peripheral retaining groove 6.

On the top part of the pressurised container 1, there is fitted a dispenser cap constituted by two components made of a moulded plastic material namely: on the one hand, a cap body designated by 10 as a whole, and on the other hand, a push button 30 articulated to the said cap body.

The cylindrical wall or skirt 11 of cap body 10 is provided internally, on its lower portion, with a discontinuous retaining ring 12 which allows the cap to be substantially irremovably fixed on the top part of container 1 by catch engagement within the retaining groove 6.

A window 13 and a diametrically opposite notch 14 are formed in the top part of skirt 11 in its connecting zone with the top 15 of cap body 10. The side edges of window 13 and of notch 14 are interconnected in pairs by two chordally extending guides 16 inside the cap body 10. The two guides 16 are disposed symmetrically on either side of the axis of the cap skirt and substantially converge towards window 13; they are joined to the top 15 of the cap body. In their zone which is diametrically opposite the window 13 the two guides comprise a recess 17.

When the dispenser cap is catch-fitted on the pressurized container 1, the two guides 16 of the cap body 10 abut the crimped rim 4 of the valve mounting cup. Each of them comprises for this purpose two semi-circular cavities 18 within which the crimped rim 4 engages.

Figure 3:
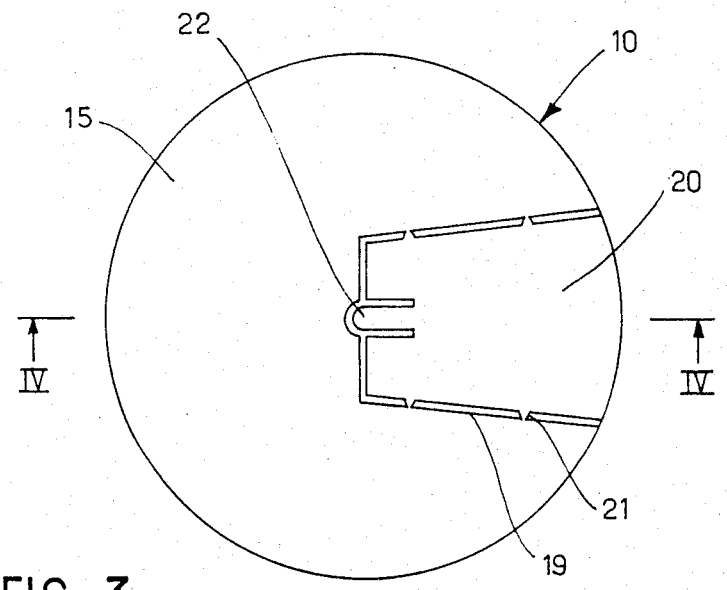
FIG. 3 is a top plan view of the dispenser cap of FIG. 1 (taken on line III—III of FIG. 1)
Figure 4:
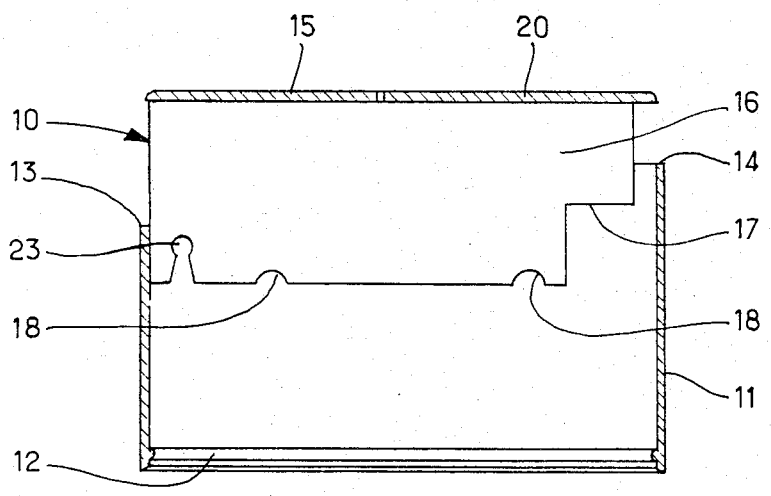
FIG. 4 is an axial cross section, taken along line IV—IV of FIG. 3, the push button not being positioned inside the cap body.

An opening 19 (FIG. 3) is formed in the top panel 15 of the cap body. Two opposite side edges of the above mentioned opening are delimited by the guides 16. The opening 19 extends from the central portion as far as the periphery of the top panel 15 of the cap body. It is obturated by a protective "tamper proofing" plate 20 which is connected by frangible connections 21, obtained by moulding, to the top panel 15 of the cap barrel.

Provision is made for a precut tab 22 (FIG. 3) in the part of the protective plate 20 which is disposed at the centre of top panel 15. In the factory, depression of the precut tab 22 by means of a tool, makes it possible to actuate the push button 30 and to adjust the atomisation of the product in the container 1, without either tearing off or damaging the protective plate 20.

Push button 30 is disposed within the cap body between the two guides 16. It comprises an L-shaped duct receiving in its axial branch 31 the outlet tube 5 of the discharge valve; the radial branch 32 opens out so that its end 33 is opposite the discharge orifice of a nozzle (not shown). The above mentioned discharge nozzle is carried by a front face 34 of the push button 30, and is disposed opposite the window 13 of cap body 10.

The radial branch 32 of the duct is surmounted by a tongue 35 extending in a plane which is substantially parallel to the axis of the said branch. The operating tongue 35 comprises two side edges which converge towards the window 13 of the cap body and cooperate with two guides 16 to ensure guidance of the push button 30 substantially in a plane passing through the sliding axis of the outlet tube 5 of the discharge valve. The length of the operating tongue 35, measured perpendicular to the axis of the cap barrel, is substantially equal to the inner diameter of the said cap skirt 11. The part of the operating tongue 35 which is on the opposite side to the radial branch 32 of the duct, is provided with an indentation to accommodate the user's finger acting on push button 30. It is also provided on the side of notch 14 with a substantially right angled return 37.

The front face 34 of the push button is provided with a downward extension 38, parallel to the axial branch 31 of the duct. The cross section of this front extension 38 in a direction perpendicular to the axis of the axial duct 31 is channel-shaped. In the vicinity of the bottom end of the front extension 38, and on the sides of the channel formed by the said extension, there are provided in relief two coaxial trunnion elements 39 integrally moulded with push button 30. The two coaxial trunnion elements 39 extend perpendicular to the axis of the axial branch 31 of the bent duct. They are catch-fitted within the two downwardly open housings 23 at the base of the two guides 16 in their part which is adjacent to window 13 of the cap body. Each housing 23 is constituted by a cylindrical cavity communicating downwardly with a frustoconical opening whose two walls converge towards the said cavity.

On the side opposite the front extension 38, the two side edges of the operating tongue 35 are extended downwards by a bent tab 40. The ends of the two bent tabs 40 which are not connected to push button 30, are disposed substantially in a plane which is perpendicular to the axis of the axial branch 31 of the duct and projects outwardly of the push button 30. They abut against bottom 17*a* of the recesses 17 cut out in the two guides 16 when tongue 35 of the push button 30 is substantially parallel to the top panel 15 of the cap body. The cooperation of the two restraining tabs 40 with the bottom of the recesses 17 has the object of limiting the upward rotational movement of push button 30 in a position wherein the operating tongue 35 comes to be practically at the level of the upper surface of the top panel 15 of the cap body 10.

To fix the push button 30 within cap body 10, the cap body is up-ended and push button 30 is lowered between the two guides 16 until the two trunnion elements 39 are catch-engaged within their housing 23. In this position, the two restraining tabs 40 abut against the underside of the guides 16 at the recesses 17. Thus, thanks to the presence of the two restraining tabs 40, the lowering of the push button 30 within the cap may be effected without any risk of damage to the protective plate 20.

The assembly of the dispenser cap on the pressurised container 1 described above, is effected without any difficulty by the catch-engagement of the discontinuous retaining ring 12 provided on the bottom of cap skirt 11 within the preformed groove 6 of the pressurised container 1. The fixing of the cap on the pressurised container 1 may be effected without any particular precaution and without the risk of depressing the outlet tube 5 of the discharge valve since this driving down movement is limited by the bearing of the two guides 16 on the crimped rim 4 of the valve carrier cup.

When the protective plate 20 is torn off, there is no unsightly discontinuity between the two guides 16 of the cap body since tongue 35 of the push button comes to be substantially at the level of the top panel 15 of the cap body. Moreover, since the articulation axis defined by the two trunnion elements 39 is substantially at the level of the end of the outlet tube 5 of the discharge valve, and since moreover the length of the tongue 35 of the push button is substantially equal to the inner diameter of the cap skirt, it will be understood that the operation of depressing the push button 30 and hence the outlet tube of the discharge valve, should require particularly little effort.

It should also be noted that, thanks to the presence of the front extension 38, the dispenser cap according to the invention may have any height whatever without deleteriously affecting the operation of the push button 30, or its aesthetic appearance due to the existence of a continuity between the two guides 16 of the cap body. Dispenser caps of various heights may easily be obtained with the same diameter, merely by adjusting the height of the front extension 38 of the axial branch 31 of the duct and of the two restraining tabs 40.

Figure 5:
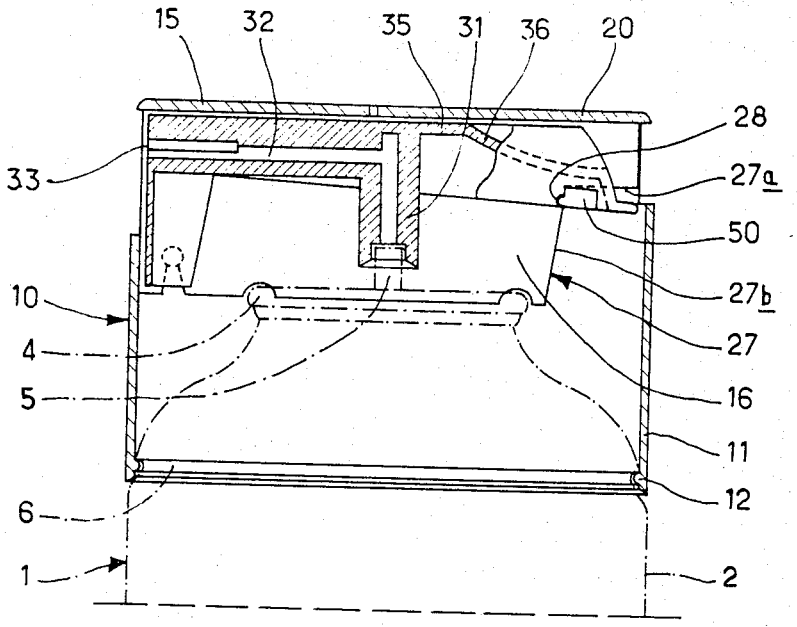
FIG. 5 is a partial axial cross section of a dispenser cap according to the second variant, wherein the push button may be held provisionally in a fixed position within the cap body by catch engagement of its restraining tabs on the guides of the cap body.
Figure 6:
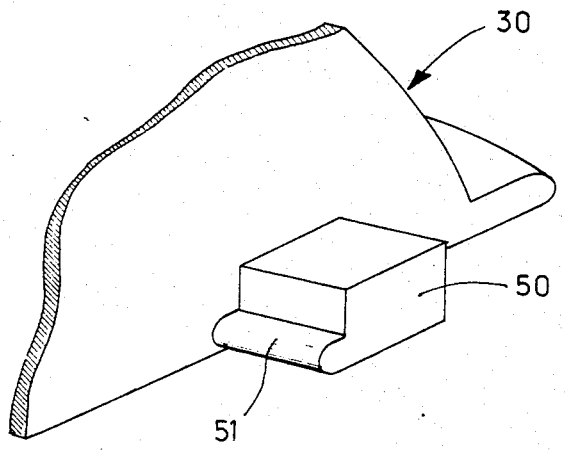
FIG. 6 is a detail on an enlarged scale of a restraining tab of the push button of FIG. 5.

The dispenser cap shown in FIG. 5 is a variant similar to that of FIGS. 1 to 4, save for the difference that the push button may be kept in a fixed upper position by catch engagement with the cap.

The cap body of FIG. 5 is essentially distinguished from that of FIGS. 1 to 4 only by the shape of the recesses 27 on the two guides 16 of the cap body. Each recess 27 comprises a bottom 27*a* which extends perpendicular to the axis of the cap skirt 11 and is connected to a slightly inclined wall 27*b* in relation to the axis of the cap skirt 11. The inclined wall 27*b* and the axis of the cap barrel 10 substantially diverge towards the top panel 15 of the cap body 10.

A notch 28 is formed on the inclined wall 27*b* near its connecting zone with the bottom 27*a* of the recess 27.

Figure 2:
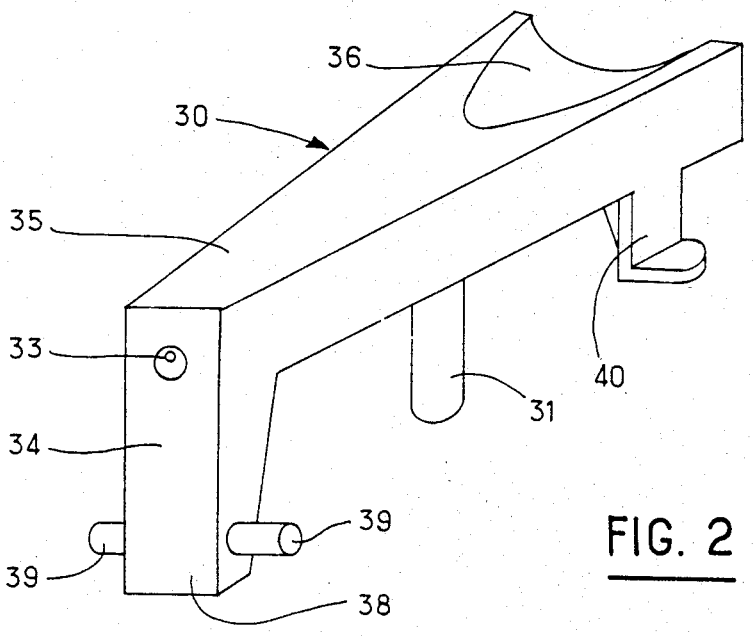
FIG. 2 is a view in perspective of the push button of the dispenser cap of FIG. 1.

The push button of the embodiment of FIG. 5 is distinguished from that of FIGS. 1 and 2 essentially in that the restraining tabs 50 are not laterally outwardly bent whereas the restraining tabs 40 of the push button of FIGS. 1 and 2 were bent. The two restraining tabs 50 also have the function of limiting the upward rotational movement of push button 30. They comprise in relief on their edge facing towards the articulation axis, a retaining bead 51 which is capable of being catch-engaged within notch 28 of recess 27 to prevent premature rotation of push button 30 within cap body 10.

The push botton 30 is fixed within the cap body 10 by up-ending the cap body and by lowering the push button 30 between the two guides 16 until the catch engagement of, on the one hand, the two trunnion elements 39 within their recesses and, on the other hand, the retaining bead 51 of the restraining tabs 50 within the notch 28 of recesses 27. In this position, the push button 30 is prevented from premature rotation within the cap body, thus facilitating mounting of this cap/button unit on the pressurised container 1.

When the protective plate 20 has been torn off, the user presses on push button 30 to release it from its catch-engagement position and to pivot about its articulation axis, the slope given to the sides 27*b* of recesses 27 being such as to allow the free movement of the restraining tabs 50 within the recesses 27. It should be noted that the restraining tabs 50 cannot return to their original catch-engagement positions unless an upward pull is exerted on push button 30.

Figure 7:
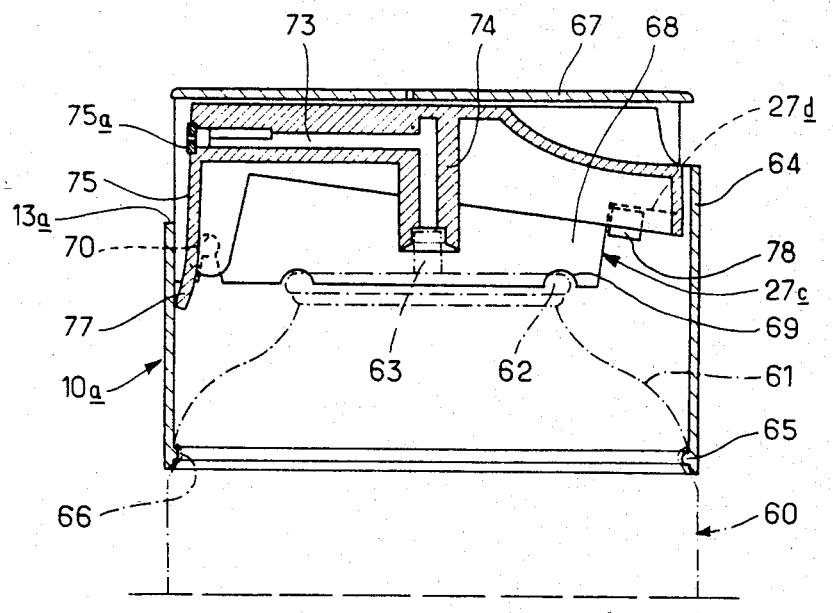
FIG. 7 is an axial cross section of a dispenser cap according to the third variant, the upper portion of the associated pressurised container being shown in dash-dot lines.

In FIG. 7, the top of a pressurised container 60 has been shown in dash dot lines. The container 60 ends in an ogival part 61 whose edge 62 is crimped to a mounting cup carrying a valve 63. The dispenser cap according to the invention comprises a body 10*a* intended to be fixed on the container 60; this body 10*a* comprises a side wall or skirt 64 whose bottom part carries an inner retaining bead 65 intended to be catch-engaged in a groove 66 formed on the top part of container 60. In this way, the cap is attached by its base on the top part of the container.

The body of the cap comprises, moreover, a top panel 67 and two inner sides or guides 68 which are integral with the top panel 67 and the skirt 64 and which together define a housing for the push button 71 of the cap.

The lower edges of guides 68 have notches 69 intended to contact the crimped rim of the crimped edge 62 of the container so that when the retaining bead 65 is catch engaged in the groove 64, the guides 68 abut the container. The guides 68 delimit, moreover, the two recesses 70 allowing the push button 71 to be articulated.

More precisely, push button 71 comprises a body 72 enclosing a duct which opens into a spraying nozzle 75*a* at the front part of the push button, opposite the window 13*a* of cap body 10*a*; the duct also has an axial part formed in an axial extension 74 of the body 72. This axial extension 74 is intended to cooperate with the outlet tube of discharge valve 63. The body 72 of the push button comprises in its front part, a downwardly extending extension 75*b* of the front face 75, the bottom of the extension 75*b* being provided with two lateral trunnion elements 76 intended to be elastically held in recesses 70 of the cap guides. These trunnions 76 allow the push button 71 to rotate in relation to the cap around an axis which is substantially perpendicular to the plane of FIG. 7.

In the embodiment of FIg. 7, the extension 75*b* of the front face 75 of the push button 71 carries a downwardly extending strip 77. This strip 77 is sufficiently curved forwardly so that when the push button occupies its uppermost position (i.e. when it is nearest to the top 67), as shown in FIG. 7, the strip 77 should still bear against the skirt 64 of the cap and exert a force ensuring that the push button 71 is kept in the position shown in FIG. 7. More precisely, strip 77 is sufficiently forwardly curved for it to exert permanently a sufficiently high force to return the push button always into the position shown in FIG. 7.

To assemble the dispenser cap shown in FIg. 7, the push button 71 is introduced into the cap body from below and is pushed upwardly; meanwhile the tongue 77 acts to push the push button rightwardly as viewed in FIG. 7. When the trunnions 76 come into contact with the guides 68 of the cap, they are guided through the flared inlet openings of recesses 70 so that the strip 77 is progressively compressed against the skirt 64 of the cap body 10*a*. The dispenser cap is fully assembled, when the trunnions 76 have been snap-engaged in their recesses 70.

It is desirable for the body 72 of the push button 71 to comprise lateral projections 78 intended to limit the upward displacement of the push button when they abut the undersides of the guides 68 which each have a recess 27*c* whose bottom 27*d* is intended to form a stop surface for the associated projection 78.

The strip 77 of the push button has been described as having been integrally moulded with the push button.

Figure 8:
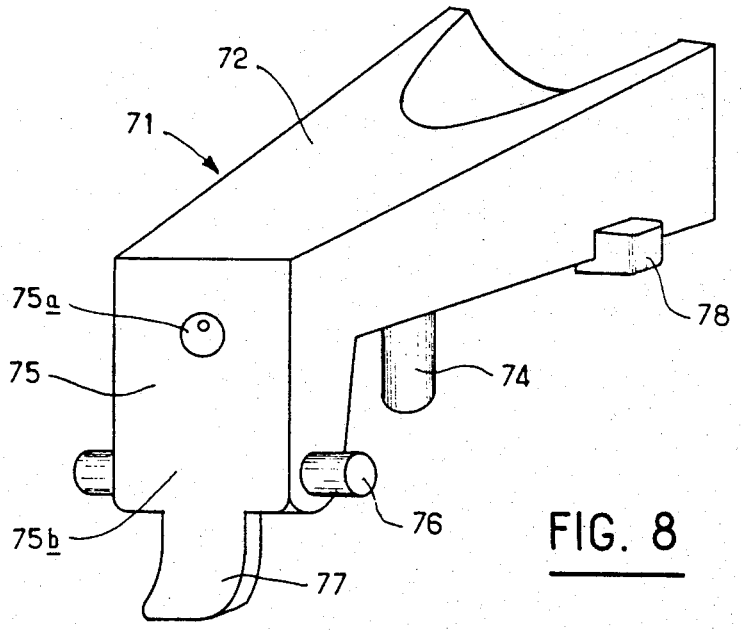
FIG. 8 is a view in perspective of the push button of the cap of FIG. 7.

It is, however, possible for this to be attached or to have a different shape. In the shape shown in FIG. 8, the width of strip 77 is smaller than that of extension 75*b*, so much so that the strip deforms before the extension itself. This priority of deformation could be obtained with a strip 77 having substantially the same width as extension 75*b* but a lesser thickness.

Whatever the shape of the biasing strip, it is desirable for it to exert a sufficient returning force for the push button 77 always to return to the top position, even when no force is exerted on it by the discharge valve outlet tube 63. In this way, when the cap is assembled but not fixed to a container 60 the axial extension 74 of the push button 71 is coaxial in the cap to allow automatic positioning of the cap on its container 60, for the extension 74 is duly presented opposite the outlet tube 63 of the valve.

It shall be duly understood that the dispenser caps described above may be subject to any desirable modifications without thereby departing from the scope of the invention as defined by the claims.

I claim:

1. A dispenser cap for a pressurised container of the "aerosol can" type having an annular crimped rim and a valve mounting cap carrying a discharge valve to be actuated by said dispenser cap and an outlet member to discharge fluid through said dispenser cap, when actuated, such cap comprising:

(a) first and second cap parts, the first cap part comprising a generally cylindrical cap body and said second part of the cap comprising a push button movable within said generally cylindrical cap body;

(b) catch engagement means for fixing said first cap part on the side wall of a said pressurised container;

(c) a top panel to said first cap part;

(d) means on said first cap part defining guides integral with the said cap body and connected to said top panel of the first cap part for guiding said push button for pivotal movement within said first cap part;

(e) an ejection nozzle connected to said push button;

(f) means on said push button defining a duct of bent shape having an axial branch for cooperating with the outlet member of a said associated container and a radial branch which communicates with said ejection nozzle;

(g) operating tongue means connected to said push button extending at least in a zone thereof remote from said radial branch of the duct, and substantially perpendicular to said axial branch of the duct means, said push button having a length measured perpendicular to the axis of the cap body which is substantially equal to the inner diameter of the said cap body said operating tongue means of the push button being substantially disposed at the level of said top panel of the first cap part;

(h) an extension of said push button adjacent to said ejection nozzle, said extension being parallel to said axial branch of the duct means and aligned in a direction which extends toward said catch engagement means of the first cap part, said extension having a proximal end near said ejection nozzle and a distal end remote therefrom;

(i) two coaxial pin means adjacent said distal end of the extension for articulating the push button on the cap body;

(j) means on said cap body defining a window in register with said ejection nozzle of the push button;

(k) means defining recesses arranged at the bottom of said guides of the cap body, said recesses opening downwardly toward the container and arranged near said window thereof receiving said pin means and thereby defining an axis of articulation substantially at the level of the end of said discharge valve outlet member, said two coaxial pin means being integral with the said extension and being catch-engaged within said recesses; and (l) means on said guide means adapted to abut the annular crimped rim of a said pressurised container discharge valve mounting cup when the dispenser cap is catch-engaged on the said container.

2. A cap according to claim 1, wherein said operating tongue means are disposed at a level near that of said radial branch of the duct means.

3. A cap according to claim 1, wherein said cap body has an axial plane about which the guide means are substantially symmetrical, and the guides means are convergent in a direction towards said window of the cap body.

4. A cap according to claim 1, wherein said means on the guide means adapted to abut the annular crimped rim of a said associated container discharge valve mounting cap comprises two semi-circular recesses within which a said crimped rim may engage.

5. A cap according to claim 1, wherein said operating tongue means of the push button includes two integral restraining tabs which cooperate with the bottom of said guide means to limit the pivotal displacement of the push button in the direction towards said top panel.

6. A cap according to claim 5, wherein said guide means comprise guide plates and include recesses in underneath edges thereof, each said recess having a floor portion and each said restraining tab projecting outwardly of the operating tongue means and being arranged to abut the floor of a said recess on each of the said guide plates.

7. A cap according to claim 1, and further comprising, on said extension of the push button at the distal end thereof and beyond the articulation pin means thereof, elastic strip means which extend in a direction away from said axial branch of the duct means, said elastic strip means bearing elastically against the generally cylindrical side wall of the cap body and being effective to provide a force to bias the push button towards the top panel of the first cap part.

8. A dispenser cap according to claim 7, wherein said elastic strip means are integrally moulded with said push button.

9. A dispenser cap according to claim 7, wherein the elastic strip means have a thickness which is substantially equal to that of said extension of the push button but have a width which is less than that of that extension.

10. A dispenser cap according to claim 7, wherein the elasticity of the elastic strip means is sufficient for the biasing force thereof to return the push button towards its position wherein said operating tongue means is closest to the top panel of the first cap part without the help of any return biasing elements of the associated container discharge valve.

11. A cap according to claim 1, including means defining an opening in said top panel of the first cap part, said opening being flanked by said guide means, a protective plate closing said opening, and frangible connection means integrally moulded with the top panel of the first cap part and connecting said protective plate to said top panel so that said protective plate can be removed in order to allow the operation of the push button.

12. A cap according to claim 11, wherein said protective plate includes a part which is disposed substantially at the centre of the top panel of the cap body, and a precut deformable tab in its said centrally disposed part.

13. A pressurised packaging unit comprising a pressurised container of the "aerosol can" type and a dispenser cap according to claim 1 adapted to be fitted on one end of the said pressurised container, wherein the pressurised container has a generally cylindrical side wall including means defining a retaining groove serving to fix the generally cylindrical cap body thereto by catch engagement.

14. A cap as claimed in claim 1 wherein said cap body comprises a cylindrical wall having a lower edge and an internal surface adjacent said lower edge, said internal surface having a retaining bead extending at least partially around said internal surface and which constitutes said catch engagement means of said first cap part to be catch-engaged within a peripheral groove provided on the side wall of a said associated pressurised container.

15. A dispenser cap for a pressurised container of the "aerosol can" type having an annular crimped rim and a valve mounting cup carrying a discharge valve to be actuated by said dispenser cap and an outlet member to discharge fluid through said dispenser cap, when actuated, said cap comprising:

(a) first and second cap parts, the first cap part comprising a generally cylindrical cap body and said second part of the cap comprising a push button movable within said generally cylindrical cap body;

(b) catch engagement means for fixing said first cap part on the side wall of said pressurised container;

(c) a top panel to said first cap part;

(d) means on said first cap part defining guides integral with the said cap body and connected to said top panel of the first cap part for guiding said push button for pivotal movement within said first cap part;

(e) an ejection nozzle connected to said push button;

(f) means on said push button defining a duct of bent shape having an axial branch for cooperating with the outlet member of a said associated container and a radial branch which communicates with said ejection nozzle;

(g) operating tongue means connected to said push button extending at least in a zone thereof remote from said radial branch of the duct, and substantially perpendicular to said axial branch of the duct means, said push button having a length measured perpendicular to the axis of the cap body which is substantially equal to the inner diameter of the said cap body, said operating tongue means of the push button being substantially disposed at the level of said top panel of the first cap part, said operating tongue means of the push button including two integral restraining tabs which cooperate with the button of said guide means to limit the pivotal displacement of the push button in the direction toward said top panel, said guide means comprising guide plates and including recesses in underneath edges thereof, each said recess having a floor portion and each said restraining tab projecting outward of the operating tongue means and being arranged to abut the floor of a said recess of each of said guide plates, each said recess having sides as well as a said floor portion and each including catch engagement means on at least of one of said restraining tabs for catch-engagement of that restraining tab on the side of the associated said recess near the floor thereof.

16. A cap according to claim 15, wherein said side of the recess is sloping such that the said side and the axis of the generally cylindrical cap body diverge in a direction towards the top panel of the said cap body.

* * * * *